US011248820B2

(12) United States Patent
Wang et al.

(10) Patent No.: US 11,248,820 B2
(45) Date of Patent: Feb. 15, 2022

(54) AIR CONDITIONING CONTROL DEVICE TO CONTROL AIR CONDITIONER BASED ON COMFORTABLE SKIN TEMPERATURE RANGE

(71) Applicants: TSINGHUA UNIVERSITY, Beijing (CN); DAIKIN INDUSTRIES, LTD., Osaka (JP)

(72) Inventors: Fulin Wang, Beijing (CN); Toshiyuki Maeda, Osaka (JP)

(73) Assignees: TSINGHUA UNIVERSITY, Beijing (CN); Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/756,071

(22) PCT Filed: Oct. 17, 2018

(86) PCT No.: PCT/JP2018/038705
§ 371 (c)(1),
(2) Date: Apr. 14, 2020

(87) PCT Pub. No.: WO2019/078269
PCT Pub. Date: Apr. 25, 2019

(65) Prior Publication Data

US 2020/0256581 A1 Aug. 13, 2020

(30) Foreign Application Priority Data

Oct. 18, 2017 (CN) ..... 201710978216.9

(51) Int. Cl.
*F24F 11/80* (2018.01)
*F24F 11/63* (2018.01)
(Continued)

(52) U.S. Cl.
CPC ..... *F24F 11/80* (2018.01); *F24F 11/63* (2018.01); *F24F 2110/10* (2018.01); *F24F 2110/20* (2018.01); *F24F 2120/10* (2018.01)

(58) Field of Classification Search
CPC ..... F24F 11/80; F24F 11/63; F24F 2110/20; F24F 2120/10; F24F 2110/10; F24F 11/30; F24F 11/62
See application file for complete search history.

(56) References Cited

U.S. PATENT DOCUMENTS 5,145,112 A * 9/1992 Ueda ..... G06K 9/6273 236/49.3
5,291,748 A * 3/1994 Ueda ..... B60H 1/00742 236/78 D
(Continued)

FOREIGN PATENT DOCUMENTS

CN 103604191 A 2/2014
CN 104501369 A 4/2015
(Continued)

OTHER PUBLICATIONS

Olesen, B.W. and Parsons, K.C., 2002. Introduction to thermal comfort standards and to the proposed new version of EN ISO 7730. Energy and buildings, 34(6), pp. 537-548. (Year: 2002).*
(Continued)

*Primary Examiner* — Rocio Del Mar Perez-Velez
*Assistant Examiner* — Alicia M. Choi
(74) *Attorney, Agent, or Firm* — Global IP Counselors, LLP

(57) ABSTRACT

An air conditioning control device includes a control unit, a skin temperature measurement unit, an information acquisition unit, and a determination unit. The control unit controls an air conditioner that performs air conditioning of a room where a user is present. The skin temperature measurement unit measures a skin temperature of the user. The
(Continued)

information acquisition unit acquires thermal sensation information of the user regarding the space where the user is present. The determination unit determines a comfortable skin temperature range in which the user feels comfortable, based on a skin temperature of the user obtained at the time of acquiring of the thermal sensation information. The control unit controls the air conditioner based on the comfortable skin temperature range determined by the determination unit.

20 Claims, 5 Drawing Sheets

(51) Int. Cl.

| | |
|---|---|
| *F24F 110/20* | (2018.01) |
| *F24F 120/10* | (2018.01) |
| *F24F 110/10* | (2018.01) |

(56) References Cited

U.S. PATENT DOCUMENTS

| | | | | |
|---|---|---|---|---|
| 2008/0243027 | A1* | 10/2008 | Nakayama | A61B 5/01 600/549 |
| 2015/0088316 | A1* | 3/2015 | Mise | F24F 11/30 700/276 |
| 2016/0136385 | A1* | 5/2016 | Scorcioni | A47C 21/044 600/26 |
| 2018/0231269 | A1* | 8/2018 | Hiei | F24F 11/62 |

FOREIGN PATENT DOCUMENTS

| | | | | | |
|---|---|---|---|---|---|
| CN | 106225164 | A | | 12/2016 | |
| EP | 2 833 076 | A1 | | 2/2015 | |
| JP | 5-32117 | A | | 2/1993 | |
| JP | 6-58593 | A | | 3/1994 | |
| JP | 2003-254593 | A | | 9/2003 | |
| JP | 2009106674 | A | * | 5/2009 | A61B 5/0402 |
| JP | 2013-204965 | A | | 10/2013 | |
| JP | WO2016001974 | A1 | * | 1/2016 | F24F 11/02 |
| JP | 2016-90176 | A | | 5/2016 | |

OTHER PUBLICATIONS

Zhang, H., Arens, E., Huizenga, C. and Han, T., 2010. Thermal sensation and comfort models for non-uniform and transient environments, part II: Local comfort of individual body parts. Building and Environment, 45(2), pp. 389-398. (Year: 2010).*

International Preliminary Report of corresponding PCT Application No. PCT/JP2018/038705 dated Apr. 30, 2020.

International Search Report of corresponding PCT Application No. PCT/JP2018/038705 dated Dec. 4, 2018.

European Search Report of corresponding EP Application No. 18 86 7587.0 dated Jun. 14, 2021.

Wang et al. Tsinghua University, Beijing China; "Indoor thermal environment control based on thermal sensations" HVAC, Oct. 30, 2015, vol. 45(10), pp. 72-75.

* cited by examiner

| e / dt/d $\tau$ | $\leq -\delta$ | $(-\delta, \delta)$ | $\geq \delta$ |
|---|---|---|---|
| $\geq 1$ | COMFORTABLE; ROOM TEMPERATURE SETTING VALUE ± 0°C | HOT; ROOM TEMPERATURE SETTING VALUE - 1°C | VERY HOT; ROOM TEMPERATURE SETTING VALUE - 2°C |
| $(-1, 1)$ | COLD; ROOM TEMPERATURE SETTING VALUE + 1°C | COMFORTABLE; ROOM TEMPERATURE SETTING VALUE ± 0°C | HOT; ROOM TEMPERATURE SETTING VALUE - 1°C |
| $\leq -1$ | VERY COLD; ROOM TEMPERATURE SETTING VALUE + 2°C | COLD; ROOM TEMPERATURE SETTING VALUE + 1°C | COMFORTABLE; ROOM TEMPERATURE SETTING VALUE ± 0°C |

$e = t_{skin} - t_{comfort}$ $t_{comfort} = (t_{skin,up} + t_{skin,down}) / 2$ $\delta = (t_{skin,up} - t_{skin,down}) / 2$ $dt/d\tau = t_{skin}(\tau) - t_{skin}(\tau - \Delta\tau)$ $t_{skin}$ : SKIN TEMPERATURE $t_{skin,up}$ : COMFORTABLE SKIN TEMPERATURE UPPER LIMIT VALUE(°C)

$t_{skin,down}$ : COMFORTABLE SKIN TEMPERATURE LOWER LIMIT VALUE (°C)

FIG. 4

AIR CONDITIONING CONTROL DEVICE TO CONTROL AIR CONDITIONER BASED ON COMFORTABLE SKIN TEMPERATURE RANGE

CROSS-REFERENCE TO RELATED APPLICATIONS

This U.S. National stage application claims priority under 35 U.S.C. § 119(a) to Chinese Patent Application No. 201710978216.9, filed in China on Oct. 18, 2017, the entire contents of which are hereby incorporated herein by reference.

BACKGROUND

Field of the Invention

The present invention relates to an air conditioning control device that controls an air conditioner.

Background Information

An air conditioner that performs air conditioning inside a room is controlled by a built-in control device or a separately provided control device. When a user sets a setting value for the room temperature, a control device including, for example, a central processing unit (CPU) and a memory controls various devices of the air conditioner on the basis of the setting value.

SUMMARY

However, if an air conditioner is simply controlled on the basis of a setting value for the room temperature, various problems may occur in that the degree of comfort of the user cannot be improved or energy is consumed wastefully. In order to cope with these problems, the air conditioner may be controlled using standards regarding an indoor thermal environment such as the predicted mean vote (PMV) and standard effective temperature (SET); however, these do not sufficiently satisfy the needs of the user.

A problem to be solved of the present invention is to provide an air conditioning control device that improves the degree of contentment of the user.

An air conditioning control device according to the present invention includes a control unit, a skin temperature measurement unit, an information acquisition unit, and a determination unit. The control unit controls an air conditioner that performs air conditioning of a space where a user is present. The skin temperature measurement unit measures a skin temperature of the user. The information acquisition unit acquires thermal sensation information of the user regarding the space where the user is present. The determination unit determines a comfortable skin temperature range in which the user feels comfortable, on a basis of the skin temperature of the user obtained at the time of occurrence of the thermal sensation information. In addition, the control unit controls the air conditioner on a basis of the comfortable skin temperature range, which is determined by the determination unit.

According to the present invention, the thermal sensation information of the user such as hot or cold is acquired, and the comfortable skin temperature range, in which the user feels comfortable, is determined on the basis of the skin temperature of the user obtained at the time of occurrence of the information. The air conditioner is controlled on the basis of the comfortable skin temperature range, and thus the user's degree of contentment regarding air conditioning is improved.

Note that, preferably, the control unit controls the air conditioner also on a basis of the current skin temperature of the user in addition to the comfortable skin temperature range, which is determined by the determination unit.

In addition, preferably, the air conditioning control device further includes a measurement unit that measures a temperature and/or a humidity of air in the space where the user is present. In this case, preferably, the control unit controls the air conditioner also on a basis of a measurement value of the measurement unit.

In addition, preferably, the skin temperature measurement unit has an infrared thermography that analyzes an infrared ray emitted from the user.

In addition, preferably, the skin temperature measurement unit measures the skin temperature of the user at least once in five minutes. In this case, the control unit estimates current thermal sensation of the user on a basis of the comfortable skin temperature range, which is determined by the determination unit, the current skin temperature of the user, and a rate of change of the skin temperature of the user, and controls the air conditioner on a basis of the estimated current thermal sensation of the user. Preferably, the determination unit updates the comfortable skin temperature range, in which the user feels comfortable, at the time of occurrence of the thermal sensation information of the user.

In addition, preferably, the determination unit selects a lower limit of the comfortable skin temperature range, in which the user feels comfortable, from a range of 31° C. to 33° C., and selects an upper limit of the comfortable skin temperature range, in which the user feels comfortable, from a range of 33° C. to 35° C.

In addition, preferably, the determination unit has an initial value of the comfortable skin temperature range, in which the user feels comfortable, and changes the initial value in accordance with a season or a time period.

In addition, in a case where a plurality of users are present, preferably, the control unit controls the air conditioner on a basis of comfortable skin temperature ranges of the plurality of users such that a total degree of comfort of the plurality of users is increased, or such that a degree of comfort of the user having a lowest degree of comfort among the plurality of users is increased, or in accordance with prioritized order set for each of the plurality of users.

BRIEF DESCRIPTION OF THE DRAWINGS

FIG. 4 is a table illustrating a method for determining a room temperature setting value using fuzzy logic.

DETAILED DESCRIPTION OF EMBODIMENT(S)

(1) Configuration of Air Conditioning Control Device

Figure 1:
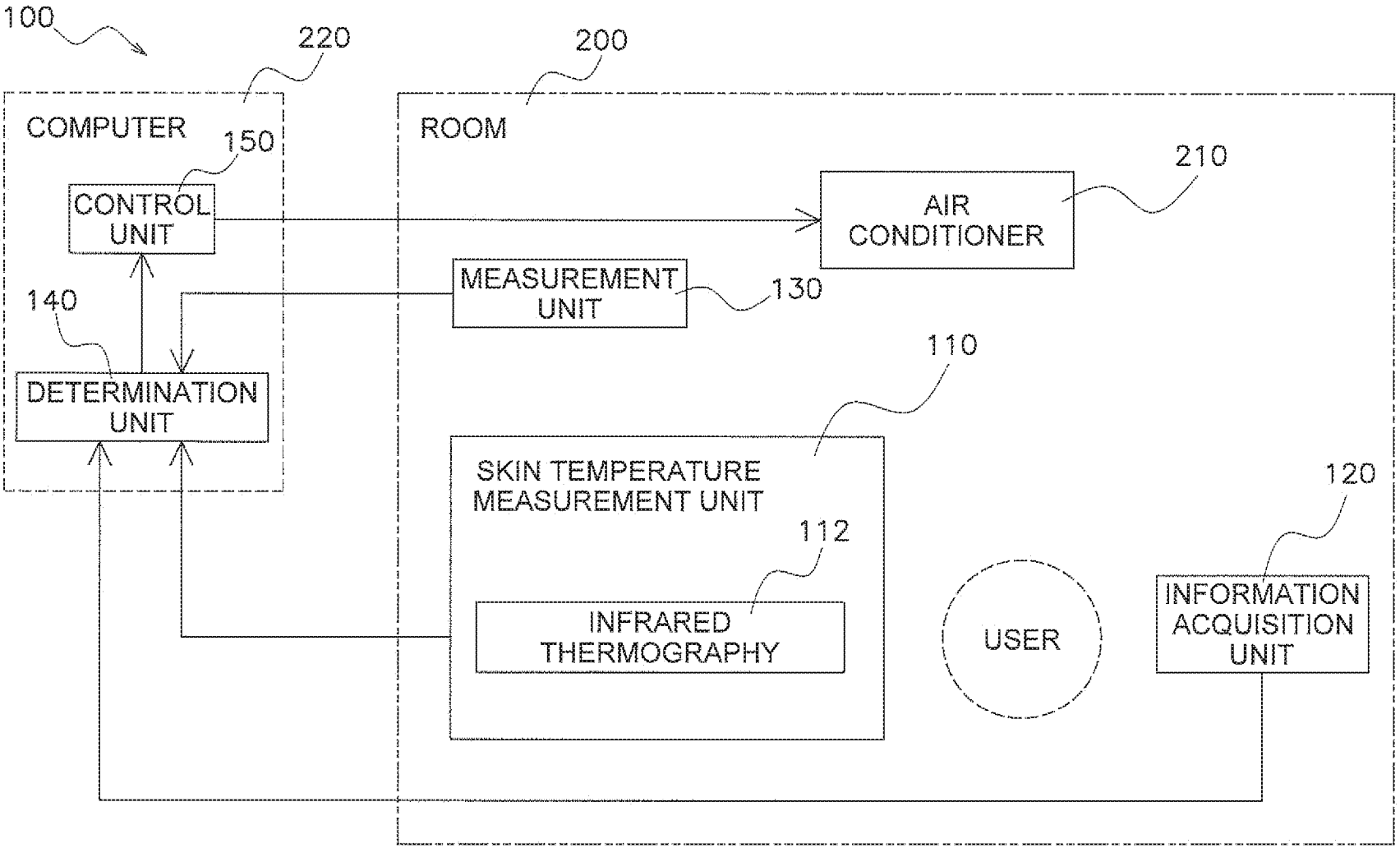
FIG. 1 is a schematic block diagram illustrating the configuration of an air conditioning control device.

FIG. 1 illustrates an air conditioning control device 100, which is a control device for an air conditioner 210, which for example cools, heats, and ventilates a room (space) 200 where the user is present. The air conditioning control device 100 includes a control unit 150, a skin temperature measurement unit 110, an information acquisition unit 120, a determination unit 140, and a measurement unit 130.

Figure 5:
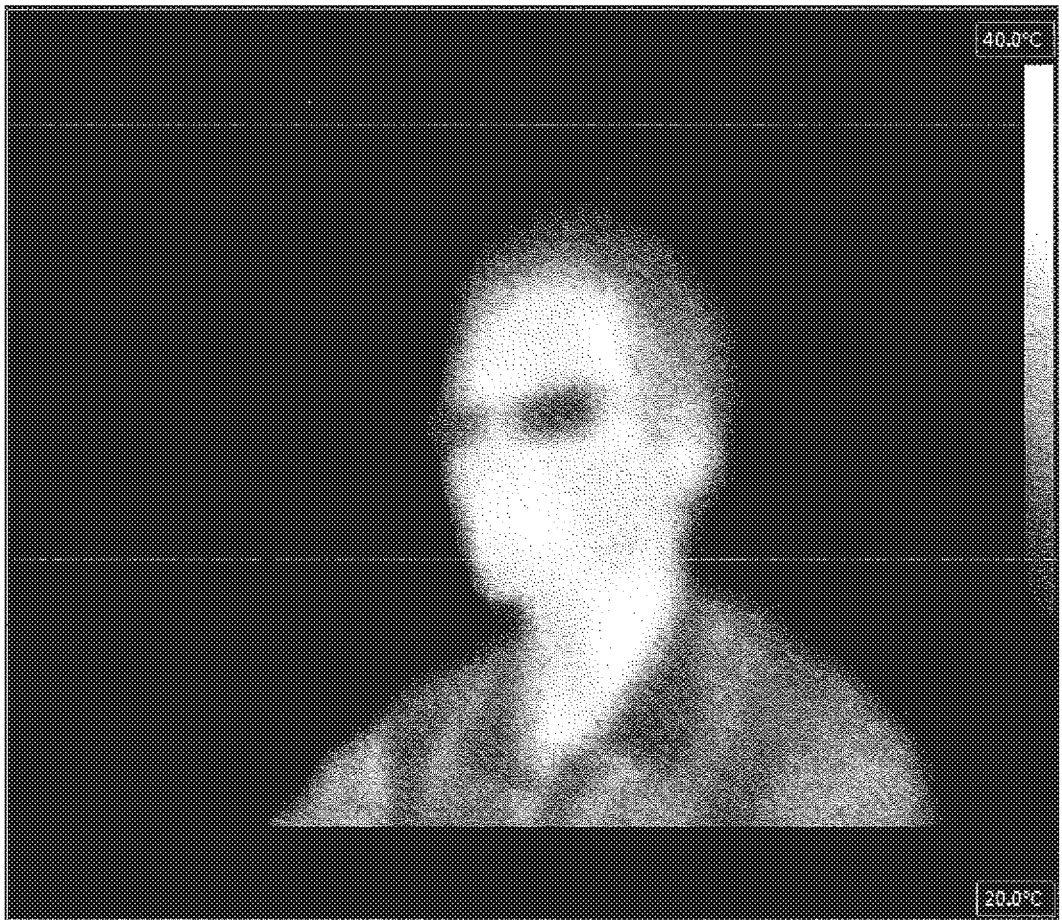
FIG. 5 is an image including a skin temperature of a user captured by an infrared thermography.

The skin temperature measurement unit 110 has an infrared thermography 112, which analyzes infrared rays emitted from the user. An image as illustrated in FIG. 5 can be obtained by using the infrared thermography 112. From this image, the skin temperature measurement unit 110 measures the skin temperature of the user.

The information acquisition unit 120 acquires thermal sensation information of the user. The information acquisition unit 120 is, for example, an input device such as a display with a touch panel function (man machine interaction device) or a keyboard, and sends thermal sensation information input by the user to a computer 220 in a wired or wireless manner. In a case where a display with a touch panel function is employed as the information acquisition unit 120, preferably, an application is installed on the device and the software helps the user to perform input. In addition, if a plurality of mechanical input buttons are employed as the information acquisition unit 120 and the user is caused to manually input thermal sensation information such as hot or cold, it is possible to reduce the cost of the input device.

Note that, in this case, a display with a touch panel function is employed as the information acquisition unit 120, and it also serves as a device through which the user inputs a temperature target value and a humidity target value for the room.

The determination unit 140 and the control unit 150 are function units that are caused to function by a program executed by the computer 220. The determination unit 140 determines a comfortable skin temperature range in which the user feels comfortable, on the basis of the skin temperature obtained at the time of occurrence of thermal sensation information, that is, the skin temperature of the user obtained at the time when the user inputs the thermal sensation information in this case. The control unit 150 controls the air conditioner 210 on the basis of the comfortable skin temperature range, which is determined by the determination unit 140.

The computer 220 includes a central processing unit (CPU), a memory, and a storage device storing programs, functions as the control unit 150 when a program for air conditioning control is executed, and functions as the determination unit 140 when a program for determining a comfortable skin temperature range, in which the user feels comfortable, is executed. The programs executed by the computer 220 include many logic functions and program code modules realizing process execution commands.

The measurement unit 130 measures, for example, the temperature, humidity, and carbon dioxide (CO2) concentration of air in the room 200, where the user is present. Specifically, the measurement unit 130 is constituted by a plurality of sensors including a temperature sensor and a humidity sensor.

A measurement value of the measurement unit 130 is used by the control unit 150 to control the air conditioner 210. The details will be described later.

Figure 2:
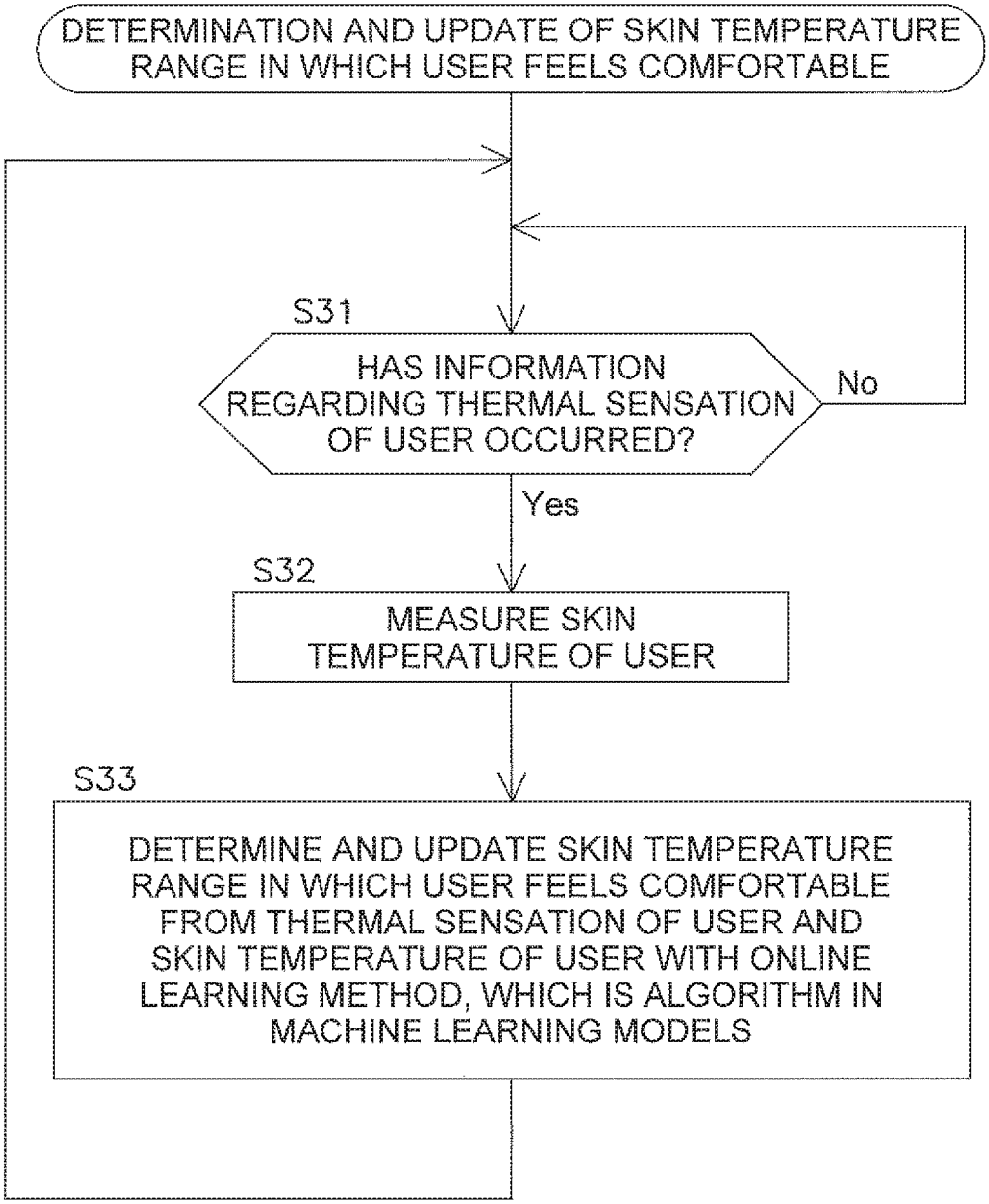
FIG. 2 is a flow chart for determining and updating a comfortable skin temperature range in which a user feels comfortable.

(2) Determination and Update of Comfortable Skin Temperature Range, in which User Feels Comfortable, Performed by Determination Unit FIG. 2 illustrates a flow chart regarding an operation of the determination unit 140, that is, determination and update of the comfortable skin temperature range, in which the user feels comfortable.

The determination unit 140 monitors at all times whether thermal sensation information of the user, an example of which is input information such as hot or cold, has been sent from the information acquisition unit 120, which is an input device (step S31). In step S31, in a case where it is determined that no thermal sensation information of the user has occurred, that is, there is no input, the determination unit 140 remains on standby. In a case where, in step S31, the determination unit 140 determines that thermal sensation information of the user has occurred, the process proceeds to step S32 and the skin temperature of the user is measured or acquired. As the skin temperature of this user, the skin temperature measured shortly before occurrence (input) of the thermal sensation information of the user may be employed or the skin temperature measured right after the occurrence may be used.

Note that the skin temperature measurement unit 110 measures the skin temperature of the user at least once in five minutes, and once in a minute in this case.

In step S33, the determination unit 140 determines a comfortable skin temperature range, in which the user feels comfortable, with an online learning method, which is an algorithm in machine learning models, using the thermal sensation of the user and the skin temperature of the user. In addition, in a case where a comfortable skin temperature range is already present, the data of the old comfortable skin temperature range used so far is replaced (updated) by the determined comfortable skin temperature range.

By using the online learning method, specifically, when the user inputs that he or she is feeling hot, the determination unit 140 replaces a comfortable skin temperature upper limit value with the skin temperature of the user obtained at the time when the user performs input. In contrast, when the user inputs that he or she is feeling cold, the determination unit 140 replaces a comfortable skin temperature lower limit value with the skin temperature of the user obtained at the time when the user performs input.

Note that, in this case, on the basis of study results regarding the thermal sensation of many people, the determination unit 140 selects the lower limit of the comfortable skin temperature range (the comfortable skin temperature lower limit value) from a range of 31° C. to 33° C. In addition, the determination unit 140 selects the upper limit of the comfortable skin temperature range (the comfortable skin temperature upper limit value) from a range of 33° C. to 35° C.

(3) Air Conditioning Control Performed by Control Unit

As described above, the control unit 150 executes air conditioning control. The control unit 150 performs air conditioning control on the basis of the comfortable skin temperature range, which is determined by the determination unit 140. In addition, the control unit 150 estimates the current thermal sensation of the user on the basis of the current skin temperature of the user and the rate of change of the skin temperature of the user in addition to this comfortable skin temperature range, and performs air control on the basis of the estimated current thermal sensation of the user.

Figure 3:
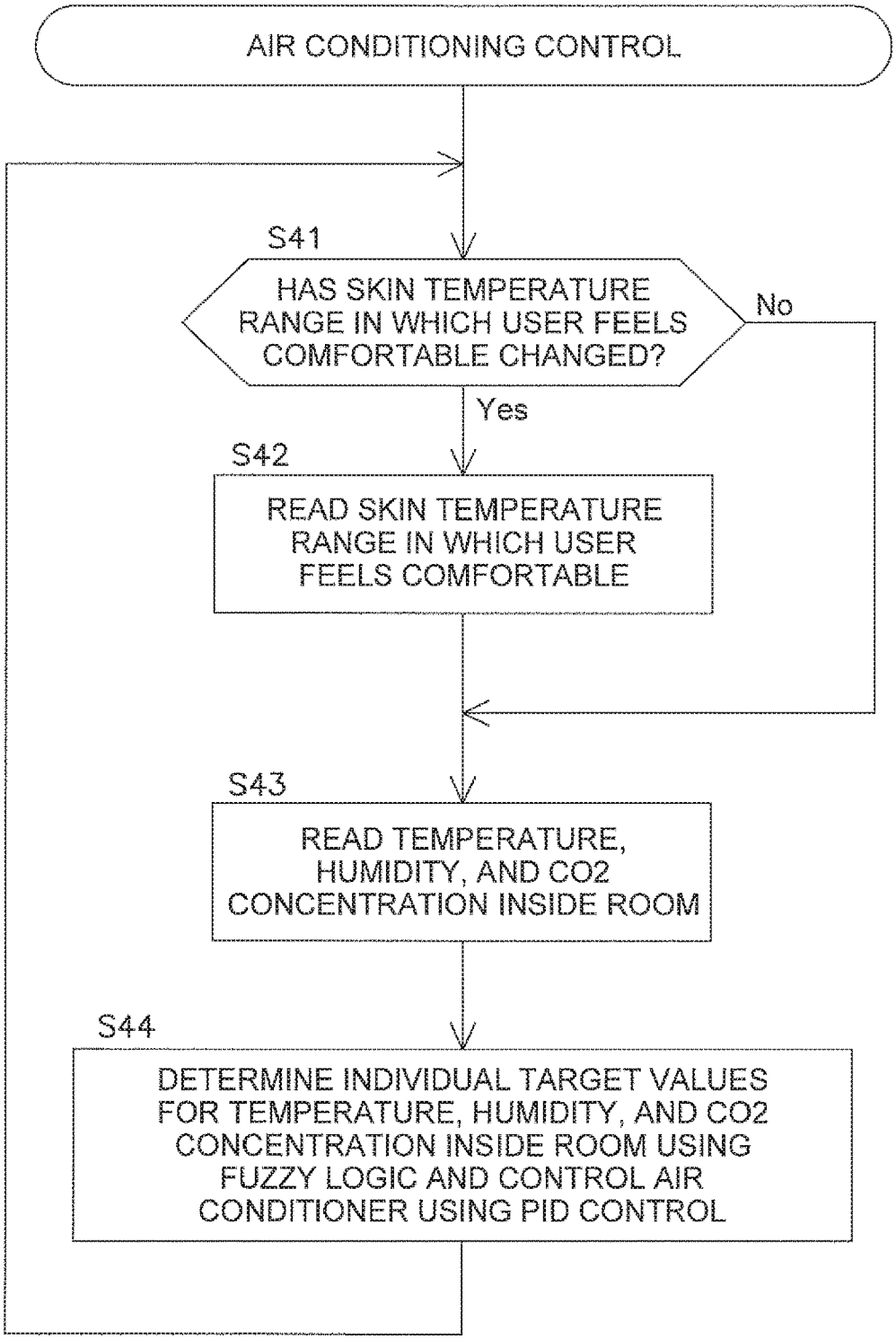
FIG. 3 is a flow chart for air conditioning control.

FIG. 3 illustrates a flow chart of air conditioning control performed by the control unit 150. First, in step S41, it is determined whether the comfortable skin temperature range has been changed. In a case where the comfortable skin temperature range has been changed, the control unit 150 reads the comfortable skin temperature range (step S42). Otherwise, the process proceeds to step S43. In step S43, the measurement unit 130 reads measurement values of the temperature, humidity, and CO2 concentration of air in the room 200. In step S44, the control unit 150 determines individual target values for the temperature, humidity, and CO2 concentration of the room using fuzzy logic, and controls the air conditioner 210 using proportional-integral-derivative (PID) control. In the following, as an example, a method for determining a target value for the temperature of the room will be described in detail.

FIG. 4 is a table illustrating estimation of the thermal sensation of the user based on the current skin temperature of the user, and adjustment logic for a room temperature setting value (a target value for the temperature of the room) based on the estimation of the thermal sensation of the user. The control unit 150 calculates individual coefficients using the comfortable skin temperature upper and lower limit values obtained by the determination unit 140 as described above, and further obtains the rate of change of the skin temperature of the user ($dt/d\tau$) using the current skin temperature of the user (t skin). The control unit 150 then adjusts the room temperature setting value in accordance with the rate of change of the skin temperature and the difference between the current skin temperature of the user and a comfortable skin temperature (the value obtained by dividing the sum of the comfortable skin temperature upper and lower limit values by two). On the basis of the room temperature setting value and the current temperature of the room (the room temperature), the control unit 150 performs air conditioning control by, for example, increasing-decreasing an output of the compressor of the air conditioner 210 such that the room temperature approaches the room temperature setting value.

(4) Characteristics of Air Conditioning Control Device

With the air conditioning control device 100 described above, the information acquisition unit 120 acquires the thermal sensation information of the user such as hot or cold, and the comfortable skin temperature range, in which the user feels comfortable, is determined on the basis of the skin temperature of the user obtained at the time of occurrence of the information. The control unit 150 controls the air conditioner 210 on the basis of the comfortable skin temperature range, and thus the user's degree of contentment regarding air conditioning is improved.

(5) Modification of Air Conditioning Control Device

An example of the air conditioning control device has been described above, and it will be understood that various changes may be made to embodiments and their details without departing from the gist and scope of the present invention described in the claims.

For example, the determination unit 140 may change initial values of the comfortable skin temperature range, in which the user feels comfortable, in accordance with a season or a time period. Regarding the season, it is conceivable that the initial values are set to 31.5° C. to 33.5° C. in summer and the initial values are set to 32.5° C. to 34.5° C. in winter. Regarding the time period, it is conceivable that relatively low initial values are set in a rainy period and relatively high initial values are set in a dry period.

In addition, in the embodiment described above, a display with a touch panel function that causes the user to manually perform input is employed as the information acquisition unit 120; however, instead of this, a device can be employed that acquires thermal sensation information of the user by measuring, for example, sweat on the user and the user's heartbeat and voice. In this case, the user can be saved from having to manually perform input.

In addition, in the embodiment described above, the measurement unit 130 measures temperature, humidity, and CO2 concentration and air conditioning control is performed such that the individual environmental parameters approach the target values; however, the device may be a device that measures only temperature and performs air conditioning control through which only a target temperature value is adjusted.

In addition, in the embodiment described above, the skin temperature measurement unit 110 measures the skin temperature of the user once in a minute; however, if real-time measurement is performed by the infrared thermography 112, more precise air conditioning control is possible.

In addition, the above-described embodiment has been described using the flow charts illustrated in FIGS. 2 and 3 as an example; however, in the programs executed by the computer 220, the individual logic functions and program code modules may be executed in reverse order or in parallel. This will be understood by engineers of this technical field.

In addition, in the embodiment described above, the main portion of the air conditioning control device 100 is realized by hardware, software, units, or a combination therefrom. That is, many processes or methods are realized by software of an appropriate command execution system stored in the storage device or by units. However, instead of this, for example, a logic gate circuit realizing a logic function using a data signal, a discrete logic circuit, a collected circuit dedicated to logic gates, a programmable gate array, a field-programmable gate array, or the like may be employed.

In addition, the case where one user is present in the room to be cooled or heated has been described in the embodiment above; however, even in a case where a plurality of users are present in the room, the degree of contentment of one user or a plurality of users regarding air conditioning can be improved. After comfortable skin temperature ranges in which the respective users feel comfortable are determined, the air conditioning control device converts, for example, the degrees of comfort of the users into points (which indicates that the higher the point, the higher the degree of comfort) on the basis of these comfortable skin temperature ranges, and can control the air conditioner such that the total point of the users present in the room becomes the highest. Other than this, air conditioning control can be performed so as to increase the degree of comfort of the user having the lowest point (the lowest degree of comfort) among the users present in the room, or air conditioning control can be performed so as to increase the degree of comfort of the highly prioritized user based on prioritized order preset for the individual users.

What is claimed is:

1. An air conditioning control device comprising:

a computer configured to control an air conditioner that performs air conditioning of a space where a user is present;

an information acquisition unit configured to acquire thermal sensation information of the user regarding the space where the user is present; and a skin temperature measurement unit configured to measure a skin temperature of the user within a prescribed amount of time from when the information acquisition unit acquires the thermal sensation information, the computer being configured to determine a comfortable skin temperature range in which the user feels comfortable, based on the skin temperature, and control the air conditioner based on the comfortable skin temperature range determined.

2. The air conditioning control device according to claim 1, wherein the computer is further configured to control the air conditioner based on a current skin temperature of the user.

3. The air conditioning control device according to claim 2, wherein the skin temperature measurement unit is further configured to measure the skin temperature of the user at least once in five minutes, the computer is further configured to estimate a current thermal sensation of the user based on the comfortable skin temperature range, the current skin temperature of the user, and a rate of change of the skin temperature of the user, and control the air conditioner based on the current thermal sensation of the user.

4. The air conditioning control device according to claim 2, wherein the skin temperature measurement unit is further configured to measure the skin temperature of the user at least once in five minutes, and the computer is further configured to update the comfortable skin temperature range when acquiring the thermal sensation information.

5. The air conditioning control device according to claim 2, wherein the computer is further configured to select a lower limit of the comfortable skin temperature range from a range of 31° C. to 33° C., and select an upper limit of the comfortable skin temperature range from a range of 33° C. to 35° C.

6. The air conditioning control device according to claim 1, further comprising:

a measurement unit configured to measure either or both of a temperature and a humidity of air in the space where the user is present and output a measurement value indicative thereof, the computer being further configured to control the air conditioner based on the measurement value.

7. The air conditioning control device according to claim 6, wherein the skin temperature measurement unit is further configured to measure the skin temperature of the user at least once in five minutes, the computer is further configured to estimate a current thermal sensation of the user based on the comfortable skin temperature range, the current skin temperature of the user, and a rate of change of the skin temperature of the user, and control the air conditioner based on the current thermal sensation of the user.

8. The air conditioning control device according to claim 6, wherein the skin temperature measurement unit is further configured to measure the skin temperature of the user at least once in five minutes, and the computer is further configured to update the comfortable skin temperature range when acquiring the thermal sensation information.

9. The air conditioning control device according to claim 6, wherein the computer is further configured to select a lower limit of the comfortable skin temperature range from a range of 31° C. to 33° C., and select an upper limit of the comfortable skin temperature range from a range of 33° C. to 35° C.

10. The air conditioning control device according to claim 1, wherein the skin temperature measurement unit has an infrared thermography configured to analyze an infrared ray emitted from the user.

11. The air conditioning control device according to claim 10, wherein the skin temperature measurement unit is further configured to measure the skin temperature of the user at least once in five minutes, the computer is further configured to estimate a current thermal sensation of the user based on the comfortable skin temperature range, the current skin temperature of the user, and a rate of change of the skin temperature of the user, and control the air conditioner based on the current thermal sensation of the user.

12. The air conditioning control device according to claim 10, wherein the skin temperature measurement unit is further configured to measure the skin temperature of the user at least once in five minutes, and the computer is further configured to update the comfortable skin temperature range when acquiring the thermal sensation information.

13. The air conditioning control device according to claim 10, wherein the computer is further configured to select a lower limit of the comfortable skin temperature range from a range of 31° C. to 33° C., and select an upper limit of the comfortable skin temperature range from a range of 33° C. to 35° C.

14. The air conditioning control device according to claim 1, wherein the skin temperature measurement unit is further configured to measure the skin temperature of the user at least once in five minutes, the computer is further configured to estimate a current thermal sensation of the user based on the comfortable skin temperature range, the current skin temperature of the user, and a rate of change of the skin temperature of the user, and control the air conditioner based on the current thermal sensation of the user.

15. The air conditioning control device according to claim 1, wherein the skin temperature measurement unit is further configured to measure the skin temperature of the user at least once in five minutes, and the computer is further configured to update the comfortable skin temperature range when acquiring the thermal sensation information.

16. The air conditioning control device according to claim 1, wherein the computer is further configured to select a lower limit of the comfortable skin temperature range from a range of 31° C. to 33° C., and select an upper limit of the comfortable skin temperature range from a range of 33° C. to 35° C.

17. The air conditioning control device according to claim 1, wherein the computer has an initial value of the comfortable skin temperature range, and the computer is further configured to change the initial value in accordance with a season or a time period.

18. The air conditioning control device according to claim 1, wherein the skin temperature measurement unit is further configured to measure skin temperatures of a plurality of users including the user, the information acquisition unit is further configured to acquire the thermal sensation information of the plurality of users, the computer is further configured to determine comfortable skin temperature ranges of the plurality of users, and in a case where the plurality of users are present in the space in which the air conditioner performs air conditioning, the computer is further configured to control the air conditioner such that a total degree of comfort of the plurality of users is increased based on the comfortable skin temperature ranges of the plurality of users, or control the air conditioner such that a degree of comfort of the user having a lowest degree of comfort among the plurality of users is increased based on the comfortable skin temperature ranges of the plurality of users, or control the air conditioner based on the comfortable skin temperature ranges of the plurality of users and a prioritized order set for each of the plurality of users.

19. The air conditioning control device according to claim 1, wherein the prescribed amount of time is five minutes or less.

20. The air conditioning control device according to claim 1, wherein the information acquisition unit is an input device configured for a user to input the thermal sensation information manually, the thermal sensation information being an assessment of whether the space is hot or cold.

* * * * *